US007708912B2

(12) United States Patent
Chen et al.

(10) Patent No.: US 7,708,912 B2
(45) Date of Patent: May 4, 2010

(54) VARIABLE IMPEDANCE COMPOSITION

(75) Inventors: Pao Hsuan Chen, Taoyuan (TW); David Shau Chew Wang, Taipei (TW); Tong Cheng Tsai, Tainan (TW)

(73) Assignee: Polytronics Technology Corporation, Hsinchu (TW)

( * ) Notice: Subject to any disclaimer, the term of this patent is extended or adjusted under 35 U.S.C. 154(b) by 0 days.

(21) Appl. No.: 12/139,860

(22) Filed: Jun. 16, 2008

(65) Prior Publication Data

US 2009/0309074 A1 Dec. 17, 2009

(51) Int. Cl.
*H01B 1/14* (2006.01)
*H01B 1/20* (2006.01)

(52) U.S. Cl. ..... 252/521.2; 252/519.21; 252/519.5; 252/519.51; 252/519.54; 252/520.2; 252/521.21; 252/521.3; 252/62.3 R; 252/62.3 Q; 252/519.2

(58) Field of Classification Search ..... 252/521.2, 252/519.21, 519.5, 519.51, 519.54, 520.2, 252/521.21, 521.3, 62.3 R, 62.3 Q, 519.2
See application file for complete search history.

(56) References Cited

U.S. PATENT DOCUMENTS

| | | | | |
|---|---|---|---|---|
| 3,006,656 | A * | 10/1961 | Schaub | 280/5.509 |
| 4,220,556 | A * | 9/1980 | Oswald et al. | 502/158 |
| 4,599,206 | A * | 7/1986 | Billig et al. | 558/85 |
| 5,068,634 | A | 11/1991 | Shrier | |
| 5,310,854 | A * | 5/1994 | Heinmeyer et al. | 528/104 |
| 5,565,878 | A | 10/1996 | Lagerlof | |
| 5,781,395 | A * | 7/1998 | Hyatt | 361/127 |
| 6,013,358 | A | 1/2000 | Winnett et al. | |
| 6,058,000 | A | 5/2000 | Koenck | |
| 6,285,284 | B1 * | 9/2001 | Soe et al. | 340/572.1 |
| 6,498,715 | B2 | 12/2002 | Lee et al. | |
| 6,540,811 | B2 * | 4/2003 | Hosoe et al. | 75/348 |
| 6,548,763 | B2 * | 4/2003 | Kaltenborn et al. | 174/137 B |
| 6,642,297 | B1 | 11/2003 | Hyatt et al. | |
| 6,645,393 | B2 | 11/2003 | Lee | |
| 6,645,637 | B2 * | 11/2003 | Kaltenborn et al. | 428/447 |
| 6,750,754 | B2 * | 6/2004 | Wang et al. | 338/22 R |
| 6,806,519 | B2 * | 10/2004 | Chu et al. | 257/234 |
| 7,229,575 | B2 * | 6/2007 | Wang et al. | 252/511 |
| 2001/0009118 | A1 * | 7/2001 | Hosoe et al. | 75/255 |
| 2002/0007959 | A1 * | 1/2002 | Kaltenborn et al. | 174/137 B |
| 2003/0090855 | A1 * | 5/2003 | Chu et al. | 361/305 |
| 2003/0111648 | A1 * | 6/2003 | Chu et al. | 252/511 |
| 2004/0134599 | A1 * | 7/2004 | Wang et al. | 156/244.27 |
| 2004/0210289 | A1 * | 10/2004 | Wang et al. | 607/116 |
| 2004/0227611 | A1 * | 11/2004 | Chu et al. | 337/167 |
| 2005/0025797 | A1 * | 2/2005 | Wang et al. | 424/422 |
| 2006/0108566 | A1 * | 5/2006 | Ma et al. | 252/500 |
| 2007/0010702 | A1 * | 1/2007 | Wang et al. | 600/8 |
| 2007/0187655 | A1 * | 8/2007 | Wang et al. | 252/511 |
| 2008/0073623 | A1 * | 3/2008 | Wang et al. | 252/567 |
| 2008/0100981 | A1 * | 5/2008 | Chen et al. | 361/118 |
| 2008/0253050 | A1 * | 10/2008 | Yu et al. | 361/93.8 |
| 2008/0289751 | A1 * | 11/2008 | Wang et al. | 156/256 |
| 2009/0123716 | A1 * | 5/2009 | Ohmi | 428/213 |

FOREIGN PATENT DOCUMENTS

| | | | |
|---|---|---|---|
| DE | 102006009036 | * | 2/2007 |
| EP | 550373 | * | 7/1993 |
| FR | 2792764 A3 | * | 10/2000 |
| WO | WO/96/28951 | | 9/1996 |

OTHER PUBLICATIONS

The SEMTECH Note SI97-01, Sep. 2000.

* cited by examiner

*Primary Examiner*—Douglas McGinty
(74) *Attorney, Agent, or Firm*—Connolly Bove Lodge & Hutz LLP; Arlene P. Neal

(57) ABSTRACT

A variable impedance composition according to one aspect of the present invention comprises a high electro-magnetic permeability powder in an amount from 10% to 85% of the weight of the variable impedance composition, and an insulation adhesive in an amount from 10% to 30% of the weight of the variable impedance composition. The incorporation of high electro-magnetic permeability powder including carbonyl metal, such as carbonyl iron or carbonyl nickel, in the variable impedance composition can not only suppress the overstress voltage, but also dampen the transient current. In contrast to the conventional electrostatic discharge (ESD) device, the relatively high electro-magnetic permeability carbonyl metal powder can reduce arcing as well as lower the trigger voltage of the device. The high electro-magnetic permeability characteristics can also absorb the undesirable electro-magnetic radiation that causes corruption of signal and loss of data.

12 Claims, 2 Drawing Sheets

VARIABLE IMPEDANCE COMPOSITION

BACKGROUND OF THE INVENTION (A) Field of the Invention

The present invention relates to a variable impedance material, and more particularly, to a variable impedance material comprising high electro-magnetic permeability powder to reduce arcing.

(B) Description of the Related Art

Integrated circuits are externally fed with supply potentials and input signals to be processed and have processed output signals received from them. In particular, the input signal terminals are very sensitive, since the conductor tracks that feed the potentials and signals lead directly to a gate terminal of an input switching stage. While the integrated circuit is being manually handled, or during the automated processing to solder the integrated circuit on a circuit board, there is risk that the sensitive input stage or output stage may be destroyed by electrostatic discharge. For instance, the human body may be electrostatically charged and then discharged via the terminals leading to the outside of the semiconductor component containing the integrated circuit.

Tools of automatic component-mounting machines or test equipment may also be electrostatically charged and discharged via the semiconductor component. As technology advances and the scale of pattern lines on the semiconductor body bearing integrated circuits becomes smaller, there is a need for protection against such electrostatic discharges. Integrated circuit devices are often provided with some protection against electrostatic discharge (ESD) with high input currents, such as electrical resistors connected in their input paths, thereby limiting the input current.

U.S. Pat. No. 6,642,297 discloses a composition for providing protection against electrical overstress (EOS) comprising an insulating binder, doped semiconductive particles, and semiconductive particles. The composite materials exhibit a high electrical resistance to normal operating voltage values, but in response to an EOS transient the materials switch to a low electrical resistance and limit the EOS transient voltage to a low level for the duration of the EOS transient.

U.S. Pat. No. 6,013,358 discloses a transient voltage protection device wherein a gap between a ground conductor and another conductor is formed using a diamond-dicing saw. Substrate material selection includes specific ceramic materials having a density of less than 3.8 gm/cm$^3$ designed to optimize performance and manufacturability. An overlay layer can be provided to minimize burring of the conductors during formation of the gap.

U.S. Pat. No. 5,068,634 discloses a material and device for electronic circuitry that provides protection from fast transient over-voltage pulses. The electrode device can additionally be tailored to provide electrostatic bleed. Conductive particles are uniformly dispersed in an insulating matrix or binder to provide a material having non-linear resistance characteristics. The non-linear resistance characteristics of the material are determined by the inter-particle spacing within the binder as well as by the electrical properties of the insulating binder. By tailoring the separation between the conductive particles, thereby controlling quantum-mechanical tunneling, the electrical properties of the non-linear material can be varied over a wide range.

U.S. Pat. No. 6,498,715 discloses a stack up type low capacitance over-voltage protective device comprising a substrate, a conductive low electrode layer formed on the substrate, a voltage sensitive material layer formed on the conductive lower electrode layer, and a conductive upper electrode layer formed on the voltage sensitive material layer.

U.S. Pat. No. 6,645,393 discloses a material for transient voltage suppressors composed of at least two kinds of evenly-mixed powders including a powder material with non-linear resistance interfaces and a conductive powder. The conductive powder is distributed within the powder with non-linear resistance interfaces to relatively reduce the total number of non-linear resistance interfaces between two electrodes and, as a result, decrease the breakdown voltage of the components.

In addition to electrostatic discharge, electronic devices are also very susceptible to electro-magnetic radiation, which is particularly acute in the case of digital computing devices. The digital computing device consists of a large number of transistors, which switch and transmit signals at very high speed. Consequentially, considerable electro-magnetic radiation is generated. The stray radiation could cause erroneous state switches, corruption signals, and loss of data.

Various techniques to protect electronic devices from electro-magnetic radiation are known. It is known to use a metal enclosure to shield the device. The electro-magnetic shielding can be achieved by blocking the radiation with highly conductive surface through reflection. However, the metal enclosure is not only very costly, but also the reflective shield to block high frequency radiation often leaks due to lack of radiation dampening capability. European patent EP0550373 disclosed an inner middle layer, which was constructed based on the material with relatively high magnetic permeability and relatively low electrical conductivity. During the electromagnetic radiation strike, the middle layer absorbs most of the field's energy. The material with high magnetic permeability and low electrical conductivity is more effective at absorbing radiation than the highly conductive material.

The electrostatic and electro-magnetic coupling effect is well known for high frequency receiving and transmitting devices. U.S. Pat. No. 5,565,878 disclosed a loop-shape guard pattern, which is positioned on the sheet of the window glass for intensive electro-magnetic and electrostatic coupling between the guard pattern and an electric conductor disposed around the sheet of the window glass.

U.S. Pat. No. 6,058,000 disclosed a method of protection from electromagnetic interference and electrostatic discharge. The invention teaches a shielding conductor surface enclosure, an interior shielding conductor plane, a contact conductor from the shielding conductor plane and the shielding conductor surface enclosure, a path for electromagnetic signals to pass through a shielding conductor plane, a filter network, and an electrostatic voltage clamp. Protection is provided by filtering the incoming signals, electrically coupling the signals of an undesired bandwidth to a shield barrier, and electrically coupling signals of an undesired voltage to a shield barrier. The shield surface is physically differentiated from the ground plane surface.

The application of electro-magnetic and electrostatic discharge protection could be found from Patent WO/1996/028951—"Implant Device with Electrostatic Discharge Protection." This patent application showed that a small number of cochlear devices failed and it was found that several of the elements associated with the data receiving function were damaged by a high level electrical shock. A number of experiments were performed in a laboratory to try to induce similar failures in other cochlear devices. More particularly, implants were submersed in a saline solution simulating body fluids and tissues, and subjected to high level electromagnetic fields so as to produce electrostatic discharge (ESD) into the implant. Therefore, one should pay special attention to the device damage problem not only from the angle of electrostatic discharge, but also from the angle of electro-magnetic field.

The SEMTECH Note SI97-01 describes how the TVS diodes were applied to protect devices from the ESD damage. This note mentioned that an electrostatic discharge to the shield of the coaxial connector causes an electromagnetic wave to propagate across the transceiver board interface to the circuit board. The wave travels along the metal traces, which connect the shield to the PC board ground plane. The effects of circuit board trace inductance can result in voltage potentials greater than 1.5 kV at the CDS pin. Voltage overstress of this magnitude can cause dielectric breakdown of the transceiver chip. Also, the current impulse flowing in the conductors will result in electromagnetic coupling of transients to surrounding components on the board. The transient voltage suppression (TVS) diodes are designed to shunt the transient current away from the protected Ethernet transceiver. The TVS diodes can both suppress the voltage overstress and shunt the transient current. However, the high cost and the lack of dampening capability are still the main drawback of TVS diodes.

SUMMARY OF THE INVENTION

One aspect of the present invention provides a variable impedance material comprising a high electro-magnetic permeability powder to reduce arcing and presents a high resistance at a low applied voltage and a low resistance at a high applied voltage.

A variable impedance composition according to this aspect of the present invention comprises a high electro-magnetic permeability powder in an amount from 10% to 90% of the weight of the variable impedance composition and an insulation adhesive in an amount from 10% to 90% of the weight of the variable impedance composition.

The incorporation of high electro-magnetic permeability powder including carbonyl metal, such as carbonyl iron or carbonyl nickel, in the variable impedance composition can not only suppress the overstress voltage, but also dampen the transient current. In contrast to the conventional ESD device, the relatively high electro-magnetic permeability carbonyl metal powder can reduce arcing as well as lower the trigger voltage of the device. The high electro-magnetic permeability characteristics can also absorb the undesirable electro-magnetic radiation that causes corruption of signal and loss of data.

According to one embodiment of the present invention, the variable impedance material presents a high resistance at a low applied voltage and a low resistance at a high applied voltage. As the variable impedance material is positioned in a gap between two conductors of an over-voltage protection device, the over-voltage protection device as a whole presents a high resistance to a low voltage applied across the gap and a low resistance to a high voltage applied across the gap.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The objectives and advantages of the present invention will become apparent upon reading the following description and upon reference to the accompanying drawings in which.

DETAILED DESCRIPTION OF THE INVENTION

Figure 1:
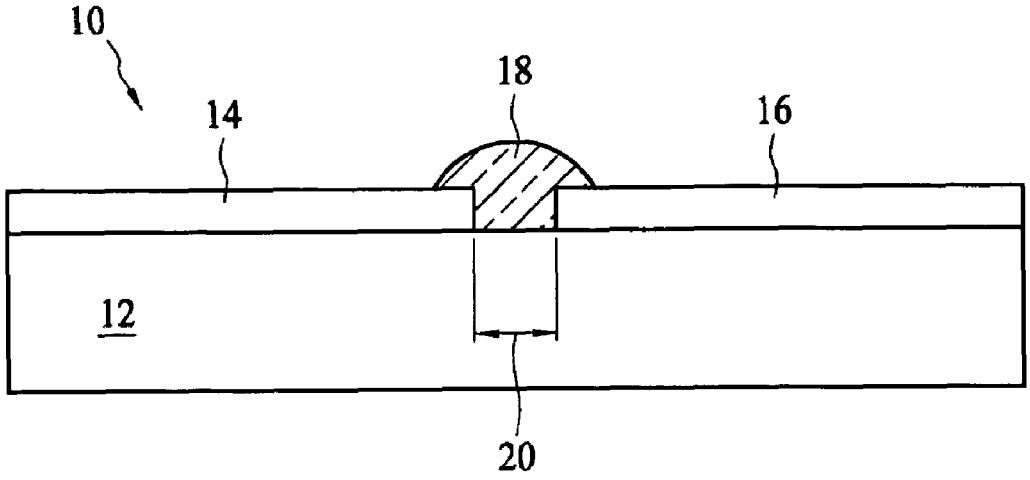
FIG. 1 illustrates an embodiment of an over-voltage protection device incorporating a variable impedance material.

FIG. 1 illustrates an over-voltage protection device 10 incorporating a variable impedance material 18 according to one embodiment of the present invention. Referring to FIG. 1, the over-voltage protection device 10 includes a substrate 12 and two conductors 14 and 16 overlying the substrate 12 and separated by a gap 20, and the variable impedance material 18 is disposed in the gap 20 between the two conductors 14 and 16. It should be appreciated that conductors 14 and 16 of any arbitrary shape can be used without departing from the scope of the present disclosure.

Figure 2:
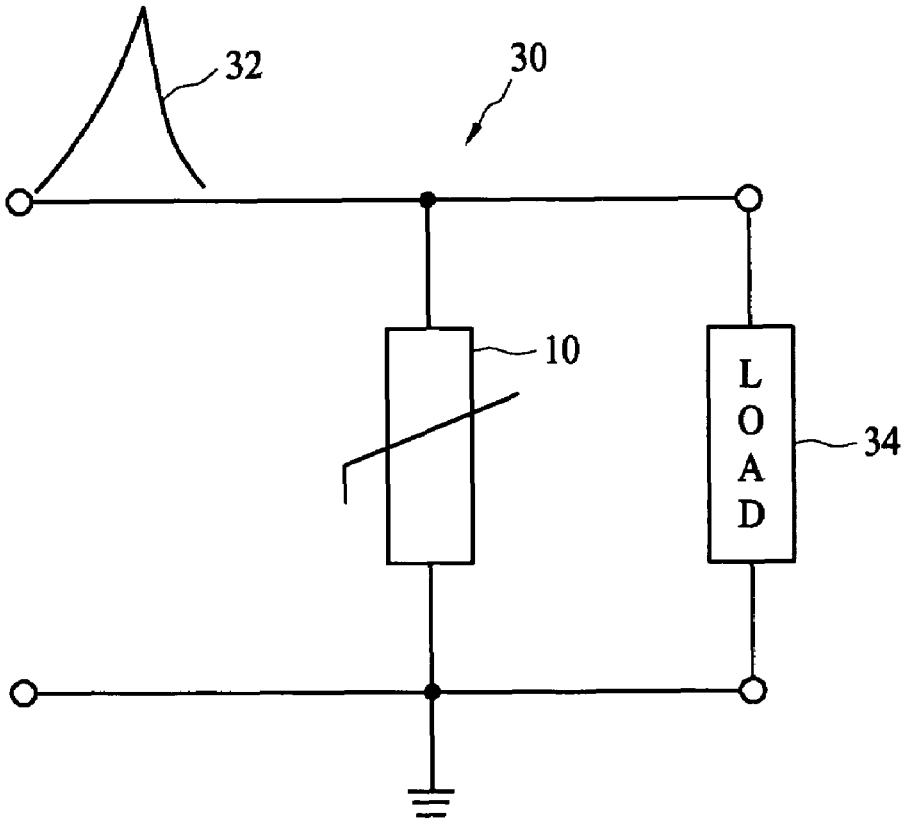
FIG. 2 illustrates an electronic circuit incorporating the over-voltage protection device to a load in parallel.
Figure 3:
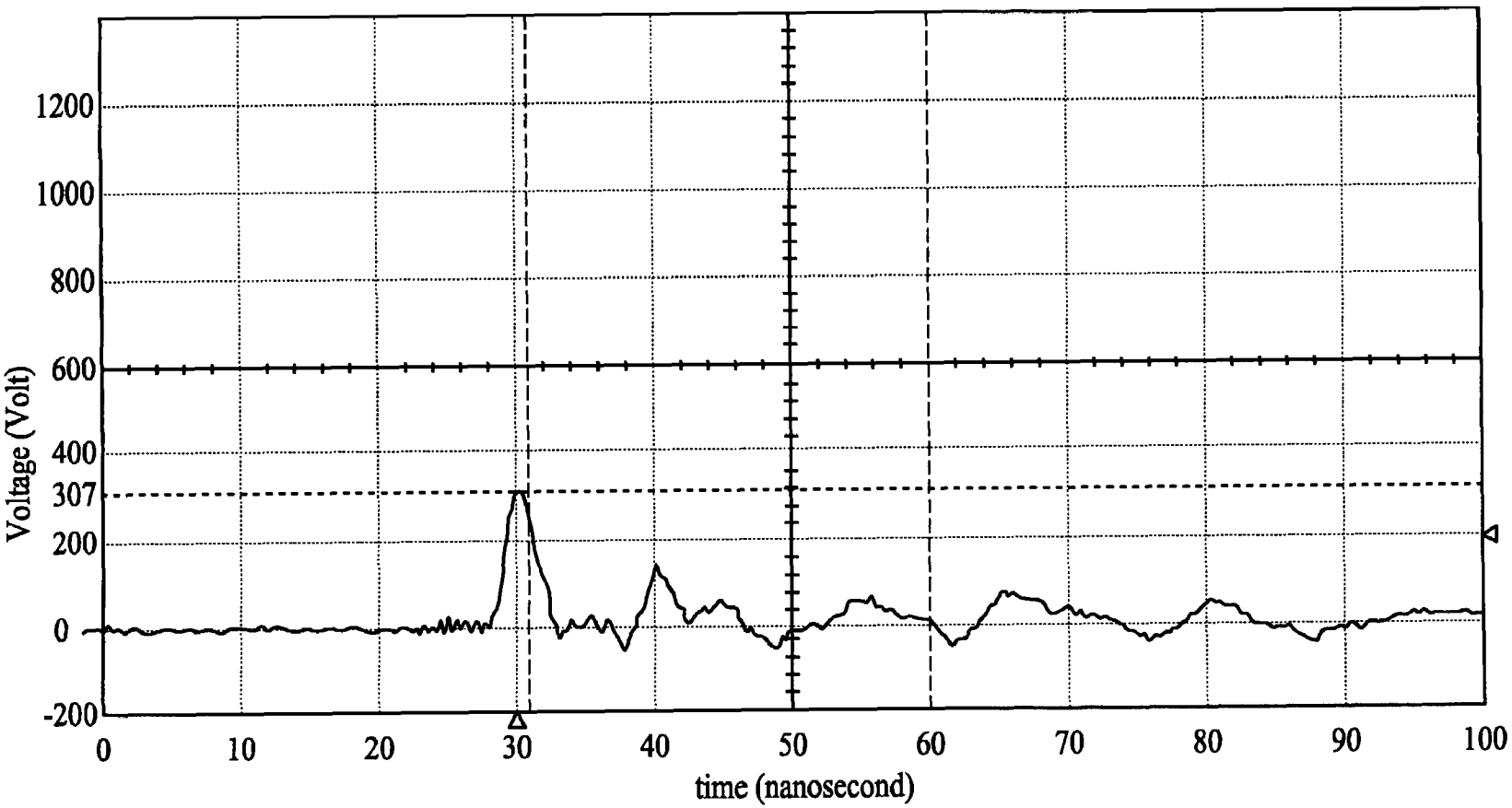
FIG. 3 shows the response of the over-voltage protection device as a transient voltage is applied to the electronic circuit.

FIG. 2 illustrates an electronic circuit 30 incorporating the over-voltage protection device 10 to a load 34 in parallel, and FIG. 3 shows the response of the over-voltage protection device 10 as a transient voltage 32 is applied according to one embodiment of the present invention. The transient voltage 32 of 2000 Volts is applied to the conductor 14 with the conductor 16 connected to the ground potential, and the over-voltage protection device 10 switches to a low electrical resistance and limits the transient voltage 32 of 2000 Volts to a trigger voltage of about 307 Volts. In other words, the load 34 connected to the over-voltage protection device 10 in parallel will not bear the transient voltage 32 of 2000 Volts, but experiences a limited trigger voltage of about 307 Volts.

Obviously, the variable impedance material 18 presents a high resistance at a low applied voltage and a low resistance at a high applied voltage. With the variable impedance material 18 positioned in the gap between the first conductor 14 and the second conductor 16, the over-voltage protection device 10 as a whole presents a high resistance to a low voltage applied across the gap and a low resistance to a high voltage applied across the gap 20 between the conductors 14 and 16.

In one embodiment, the variable impedance material 18 includes a high electro-magnetic permeability powder and an insulation adhesive. The high electro-magnetic permeability powder is in an amount from 10% to 90% of the weight of the variable impedance material 18, and preferably in an amount from 20% to 86% of the weight of the variable impedance material 18. The insulation adhesive is in an amount from 10% to 90% of the weight of the variable impedance material 18, and preferably in an amount from 14% to 80% of the weight of the variable impedance material 18.

In one embodiment, the high electro-magnetic permeability powder includes carbonyl ligand. For example, the high electro-magnetic permeability powder includes carbonyl metal such as carbonyl iron, carbonyl nickel, or carbonyl nickel/cobalt alloy. In one embodiment, the insulating adhesive includes epoxy or silicone polymer. The examples of variable impedance material 18 are shown in Table I below:

TABLE I

| Example No. | electro-magnetic permeability powder | insulating adhesive | trigger voltage |
|---|---|---|---|
| Example 1 | 86% | 14% | 353 V |
| Example 2 | 70% | 30% | 500 V |
| Example 3 | 50% | 50% | 600 V |
| Example 4 | 20% | 80% | 1157 V |

The electro-magnetic permeability powder used in the above example is enpulver SW-S (carbonyl iron powder) manufactured by BASF, and the insulating adhesive used in the above example is silicone rubber SLR9530 A&B adhesive manufactured by SIL-MORE INDUSTRIAL LTD. The trigger voltage is measured by using SANKI Electrostatic Discharge Tester (MODEL: ESD-8012A) with test condition: ESD-8012A output voltage 2 kV, INT. 90, discharges 30 times. Examples 1 to 4 all show that, within the specific range of mixing ratio, the variable impedance material 18 of carbonyl iron and silicone rubber can control the trigger voltage below 1200 volts, which is considered as the upper voltage limit for ESD protection. The content of the high electro-magnetic permeability powder shown in Table I varies from 20% to 86%, and can still limit the trigger voltage below 1200 volts. It is believed that the content of the high electro-magnetic permeability powder from 10% to 90% are suitable. Further, the content of the insulating adhesive shown in Table I varies from 14% to 80%, and can still limit the trigger voltage below 1200 volts. It is also believed that zinc oxide content levels from 10% to 90% are still suitable.

In another embodiment, the variable impedance material 18 further includes a semi-conductive powder. The semi-conductive powder may include zinc oxide or silicon carbide. The amount of semi-conductive powder ranges from 0.01% to 10%, preferably from 1% to 8%, and most preferably from 1% to 6.5% of the weight of the variable impedance material 18. The examples of variable impedance material 18 are shown in Table II below:

TABLE II

| Example No. | electro-magnetic permeability powder | Semi-conductive powder | insulating adhesive | trigger voltage |
|---|---|---|---|---|
| Example 5 | 75.80% | 6.20% | 18.00% | 1050 V |
| Example 6 | 76.77% | 5.63% | 17.60% | 892 V |
| Example 7 | 78.35% | 4.19% | 17.46% | 763 V |
| Example 8 | 80.04% | 2.75% | 17.21% | 639 V |
| Example 9 | 81.71% | 1.36% | 16.93% | 560 V |
| Example 10 | 84.50% | 1.00% | 14.50% | 390 V |

This embodiment incorporates semi-conductive powder such as zinc oxide into the mixture of carbonyl iron and silicone polymer. The zinc oxide content shown in Table II varies from 1.00% to 6.20%, and can still limit the trigger voltage below 1200 volts. It is believed that zinc oxide content levels from 1% to 10% are suitable.

In a further embodiment, the variable impedance material 18 further includes an insulation powder. The insulation powder may include metal oxide such as aluminum oxide or zirconium oxide. The amount of insulation powder ranges from 0.01% to 10%, preferably from 1% to 8%, and most preferably from 1% to 6% of the weight of the variable impedance material. The examples of variable impedance material 18 are shown in Table III below:

TABLE III

| Example No. | electro-magnetic permeability powder | insulation powder | insulating adhesive | trigger voltage |
|---|---|---|---|---|
| Example 11 | 76% | 6.00% | 18.00% | 1150 V |
| Example 12 | 80.04% | 2.75% | 17.21% | 752 V |
| Example 13 | 84.50% | 1.00% | 14.50% | 420 V |

This embodiment incorporates insulation powder such as aluminum oxide ($Al_2O_3$) into the mixture of carbonyl iron and silicone polymer. The $Al_2O_3$ content shown in Table III varies from 1.00% to 6.00%, and can still limit the trigger voltage below 1200 volts. It is believed that $Al_2O_3$ content levels from 1% to 10% are suitable. In particular, the variable impedance material 18 may include a semi-conductive powder such as zinc oxide or silicon carbide in an amount from 0.01% to 10% of the weight of the variable impedance composition.

The high electro-magnetic permeability powder includes at least one element selected from the metal magnet group consisting of Ni, Co, Fe, Al, and Nd, which was treated with organic functional group, such as carbonyl, siloxane, amine, etc. Particularly, the high electro-magnetic permeability powder was selected from carbonyl iron, carbonyl nickel, or carbonyl nickel and cobalt alloy. The carbonyl iron powder (CIP) was particularly selected for this study. The semi-conductive powder includes zinc oxide or silicon carbide, and the insulation adhesive includes epoxy or silicone. In addition, the variable impedance material 18 may further include an insulation powder of metal oxide such as aluminum oxide or zirconium oxide.

Although the present invention and its advantages have been described in detail, it should be understood that various changes, substitutions and alterations can be made herein without departing from the spirit and scope of the invention as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A variable impedance composition, comprising:

a high electro-magnetic permeability powder in an amount from 75.8% to 85% of the weight of the variable impedance composition;

an insulation adhesive in an amount from 14% to 18% of the weight of the variable impedance composition; and an insulation powder in an amount from 1% to 10% of the weight of the variable impedance composition.

2. The variable impedance composition of claim 1, wherein the high electro-magnetic permeability powder includes a carbonyl ligand.

3. The variable impedance composition of claim 1, wherein the high electro-magnetic permeability powder includes carbonyl metal.

4. The variable impedance composition of claim 1, wherein the high electro-magnetic permeability powder includes carbonyl iron.

5. The variable impedance composition of claim 1, wherein the insulation adhesive includes epoxy or silicone.

6. The variable impedance composition of claim 1, further comprising a semi-conductive powder.

7. The variable impedance composition of claim 6, wherein the semi-conductive powder is in an amount from 0.01% to 1000 of the weight of the variable impedance composition.

8. The variable impedance composition of claim 6, wherein the semi-conductive powder includes zinc oxide or silicon carbide.

9. The variable impedance composition of claim 1, wherein the high electro-magnetic permeability powder includes carbonyl nickel.

10. The variable impedance composition of claim 1, wherein the wherein the high electro-magnetic permeability powder includes carbonyl nickel/cobalt alloy.

11. The variable impedance composition of claim 1, wherein the insulation powder includes metal oxide.

12. The variable impedance composition of claim 11, wherein the metal oxide is aluminum oxide or zirconium oxide.

* * * * *